US005972585A

United States Patent [19]

Sowinski et al.

[11] Patent Number: 5,972,585

[45] Date of Patent: Oct. 26, 1999

[54] COLOR NEGATIVES ADAPTED FOR VISUAL INSPECTION

[75] Inventors: Allan F. Sowinski; Gregory G. Gresock, both of Rochester; Wayne F. Erickson, Churchville; Ronald R. Andrews, Rochester, all of N.Y.

[73] Assignee: Eastman Kodak Company, Rochester, N.Y.

[21] Appl. No.: 09/009,914

[22] Filed: Jan. 21, 1998

[51] Int. Cl.[6] ..... G03C 7/30; G03C 7/333

[52] U.S. Cl. ..... 430/504; 430/505; 430/506; 430/359

[58] Field of Search ..... 430/504, 505, 430/510, 506, 359

[56] References Cited

U.S. PATENT DOCUMENTS

| | | | |
|---|---|---|---|
| 2,449,966 | 9/1948 | Hansen | 430/396 |
| 4,992,357 | 2/1991 | Haga et al. | 430/504 |
| 5,364,753 | 11/1994 | Yamazaki et al. | 430/549 |
| 5,399,468 | 3/1995 | Sawyer et al. | 430/504 |
| 5,447,831 | 9/1995 | Singer et al. | 430/504 |

OTHER PUBLICATIONS

Science and Technology of Photography. Karlheinz Keller, pp. 114–115, 1993.

Stroebel, et al "Photographic Materials and Processes", Focal Press, Boston/London 1986, Sect. 16.8 Color–Negative Masking, pp. 525–528.

*Primary Examiner*—Richard L. Schilling
*Assistant Examiner*—Amanda C. Walke
*Attorney, Agent, or Firm*—Carl O. Thomas

[57] ABSTRACT

A color negative photographic element is disclosed containing yellow, magenta and cyan dye-forming couplers and masking dyes. Visual judging of the negative image obtained following processing is facilitated by choosing the masking dyes to provide, following imagewise exposure and processing, in CIE1976($L^*a^*b^*$) color space $L^*$ values of greater than 30 and $C^*$ values of less than 20, where $C^*$ values are derived from the formula: $C^*=[(a^*)^2+(b^*)^2]^{1/2}$.

12 Claims, No Drawings

COLOR NEGATIVES ADAPTED FOR VISUAL INSPECTION

FIELD OF THE INVENTION

The invention relates to color negative photographic elements that contain radiation-sensitive silver halide grains, dye-forming couplers and masking dyes.

BACKGROUND

Color photography in its most widely used form employs color negative film that is imagewise exposed in a camera. The color negative film includes a transparent film support and three superimposed layer units, for separately recording exposure within the blue, green and red portions of the visible spectrum. Each layer unit contains radiation-sensitive silver halide grains for selectively capturing exposing radiation in one region of the spectrum and dye-forming coupler. During processing light-struck silver halide grains containing a latent image are reduced to silver using a color developing agent. The blue, green and red recording layer units contain silver halide grains that form a latent image in response to exposure to blue, green or red exposure, respectively, and interact with coupler to form an image dye that has its principal absorption in the blue, green or red, respectively, resulting in a subtractive primary yellow, magenta or cyan dye image. As a result the multicolor image formed by the film is a negative of the scene photographed.

By altering either the silver halide grains (e.g., employing direct-positive emulsions) or the processing procedure (e.g., reversal processing) it is possible to produce dye upon reduction of only the grains that do not contain a latent image. This produces a positive dye image. The first multicolored films forming subtractive primary imaging dyes were produced by reversal processing.

Most positive multicolor images for viewing are produced in photographic elements having a reflective support—e.g., color print elements. The layer units are basically similar to those in the color negative elements described above, though differing in specifics, such as grain selections. Upon exposure of the color print through an image-bearing color negative film, a positive multicolor image (a negative of the exposing negative image) is produced in the color print.

The problem that delayed using color negative film and color print elements in combination to produce viewable multicolor images was that while the couplers produce dyes that have their principal absorption in the intended spectral region, the image dyes also exhibit significant absorption in adjacent spectral regions. When a second exposure occurs through the color negative film image, this color error is carried forward and added to the same inherent color error in the print element. Without correction, the result is unsaturated and "muddy" images, not achieving the degree of color fidelity required to be pleasing to the viewer of the color print image.

A solution to this problem allowed popular acceptance of the color negative and color print imaging system approach, which is now the most widely used approach. The solution resides in masking each dye image portion that lies outside its spectral region of principal absorption. If, for example, a green recording layer unit contains a dye-forming coupler that produces a dye that absorbs principally in the green, but also exhibits significant unwanted absorption in the blue, the incorporation of a yellow (blue absorbing) masking coupler can be used to raise blue absorption to a relatively constant level, independent of exposure. In areas in which the green recording layer unit is not light exposed the blue absorption due to the presence of the masking coupler is maintained after processing. In areas in which the green recording layer unit is exposed, the masking coupler is converted to a magenta dye along with the dye-forming coupler. The loss of blue absorption due to consumption of the masking coupler is chosen to balance the increase in blue absorption attributable to the blue absorption of the primarily magenta dye formed by the dye-forming coupler. Hence, after processing there is little, if any, image discrimination (Dmax-Dmin) in the blue region of the spectrum attributable to the green recording layer unit. Combinations of masking couplers are used to mask imagewise distributions of image dye absorptions that are outside the spectral region of principal (intended) absorption. Hansen U.S. Pat. No. 2,449,966 provides an example of early disclosure of masking couplers and their role. L. Stroebel, J. Compton, I. Current and R. Zakia, *Photographic Materials and Processes,* Focal Press, Boston/London 1986, Section 16.8 Color-Negative Masking, pp. 525 to 528, also provides a discussion of masking couplers.

Once masking couplers have been introduced to eliminate image patterns of unwanted absorption, blue, green and red characteristic curves produced by step wedge exposure, processing, and blue, green and red transmission through the negative working multicolor film differ in minimum density and usually in gamma To achieve an acceptable positive color print image by exposure through the color negative film, it is conventional practice to construct the color print to compensate exactly for the offsets in the color balance of the color negative film created by the presence of masking couplers. Once the compensating offsets have been built into the color print elements, a standard offset has been established. As a result color negative films sometimes contain uniform distributions of preformed masking dye to adjust color balance offsets to the standard profile for which the color print material is constructed. Stroebel et al, cited above, Section 16.12 Negative Color Films, provides a further description of the color balance in conventional color negative film construction.

With the emergence of computer controlled data processing capabilities, interest has developed in extracting the information contained in an imagewise exposed color negative film instead of proceeding directly to a viewable image. For example, a pattern of use that has emerged among professional photo-graphers, particularly photojournalists, is to take large numbers of pictures on location using color negative film, process the film to produce color negatives, and then select what appear to be the most promising negatives for scanning—i.e., creation of a corresponding digital image that can be transmitted to a remote location and electronically manipulated and used in any number of ways, including forming a color print. The very large number of pictures taken as well as the time and expense limitations of scanning preclude converting more than a very small fraction of the total images obtained to digital form.

Not surprisingly, one of the significant problems that has emerged in digital conversion of color negative film images is judging from visual inspection which image will be most suitable when converted to a color positive for viewing. The photographer has not only to contend with the fact that the image being judged is a negative of the image intended for final viewing, but the photographer also must contend with the color imbalances created by masking dyes. A standard color negative image has a pronounced salmon color, attributable to incorporated masking dyes.

SUMMARY OF THE INVENTION

In one aspect this invention is directed to a photographic element capable of producing a multicolor negative image comprised of a transparent film support and, coated on the support, a blue recording layer unit containing radiation-sensitive silver halide grains and coupler capable of forming following imagewise exposure and processing an image dye having its primary absorption in the blue region of the spectrum, a green recording layer unit containing radiation-sensitive silver halide grains and coupler capable of forming following imagewise exposure and processing a dye image having its primary absorption in the green region of the spectrum, a red recording layer unit containing radiation-sensitive silver halide grains and coupler capable of forming following imagewise exposure and processing a dye image having its primary absorption in the red region of the spectrum, and dyes for masking portions of the dye images that in unexposed areas of the layer units in which coupling with oxidized developing agent is absent are colored following processing, wherein, to facilitate visual judging of the multicolor dye negative image resulting from imagewise exposure and processing, the dyes for masking portions of the dye images are adjusted to provide, following imagewise exposure and processing, in CIE1976($L^*a^*b^*$) color space $L^*$ values of greater than 30 and $C^*$ values of less than 20, where $C^*$ values are derived from the formula: $C^*=[(a^*)^2+(b^*)^2]^{1/2}$.

It has been discovered that, by shifting the color balance of color negative films containing masking dyes away from the standard values suitable for direct exposure of color print elements, color negative images are produced that are more easily visually judged. This invention then reduces the burden on photographers who find it necessary to select from large numbers of color negative images a small fraction for scanning and digital conversion.

Defined in terms of CIE1976($L^*a^*b^*$) parameters, the color negative films of the invention produce images in a region of color space never previously occupied by images formed by image and masking dyes present in exposed and processed color negative films.

DESCRIPTION OF PREFERRED EMBODIMENTS

The present invention is directed in an improvement in color negative films that produce dye images intended to be converted to digital form for subsequent use. These photographic elements rely on radiation-sensitive silver halide grains for image capture and dye-forming couplers and masking couplers for dye image formation upon subsequent processing. In a simple, illustrative form the color negative film can exhibit the following layer order arrangement:

| CNF-I |
|---|
| Protective Overcoat (1) |
| Blue Recording Layer Unit (2) |
| First Interlayer (3) |
| Green Recording Layer Unit (4) |
| Second Interlayer (5) |
| Red Recording Layer Unit (6) |
| Antihalation Layer Unit (7) |
| Transparent Film Support (8) |
| Magnetic Recording Layer (9) |

Each of (1) through (7) consist of one or more processing solution permeable hydrophilic colloid layers. Each of (2), (4) and (6) contain radiation-sensitive silver halide grains that have been spectrally sensitized to the blue (2), green (4) or red (6) region of the spectrum. When the grains in (2) are silver bromide or iodobromide grains, the native blue sensitivity of the grains can be relied upon and spectral sensitization omitted. When the grains in (4) and (6) are silver bromide or iodobromide grains, (3) and, less commonly, (5) preferably contain a Carey Lea silver or a processing solution removable yellow dye to protect (4) and (6) from unwanted blue light exposure. (3) and (5) also typically contain oxidized developing agent scavengers to reduce color contamination. (7) contains gray silver or processing solution decolorizable dye to reduce halation during exposure. (9) is optional, but is typically employed to carry with the film information concerning film imaging characteristics (e.g., ISO rating), picture location, exposure and/or processing.

The blue recording layer unit (2) contains at least one dye-forming coupler which reacts with oxidized developing agent in exposed areas of the film to produce an image dye having its principal absorption in the blue region of the spectrum. A minor portion, typically less than 10 percent, of total absorption by the image dye in the visible spectrum can take place in the green portion of the spectrum. Usually absorption in the red region of the spectrum is insignificantly small. Absorption in the near ultraviolet region of the spectrum is of no consequence, since this is not visible.

To compensate at least partially for significant unwanted absorption in the green region of the spectrum, a masking coupler is included in (2) that absorbs in the green region of the spectrum prior to coupling and that reacts with oxidized developing agent (couples) to form a masking dye that absorbs principally in the blue (e.g., similarly to the absorption of the image dye) and preferably only in the blue portion of the visible spectrum. The masking dye has the effect of raising the minimum absorption in (2) in the green spectral region in unexposed areas toward the green spectral region absorption of the image dye formed in exposed areas. The net effect, after imagewise exposure and processing, is to create a more nearly uniform green density in (2) that is relatively small (e.g., <10%) of the maximum density of (2) in the blue region of the spectrum.

The green recording layer unit (4) contains at least one dye-forming coupler which reacts with oxidized developing agent in exposed areas of the film to produce an image dye having its principal absorption in the green region of the spectrum. A minor portion, typically less than 10 percent, of total absorption by the image dye in the visible spectrum can take place in each or either of the blue and red portions of the spectrum.

To compensate at least partially for significant unwanted absorption in the blue spectral region, a masking coupler is included in (4) that absorbs in the blue region of the spectrum prior to coupling and that couples to form a masking dye that absorbs principally in the green (e.g., similarly to the absorption of the image dye) and preferably only in the green portion of the visible spectrum. The net effect, after imagewise exposure and processing, is to create a more nearly uniform blue density in (4) that is relatively small (e.g., <10%) of the maximum density of (4) in the green region of the spectrum.

To compensate at least partially for significant unwanted absorption in the red spectral region, a second masking coupler is included in (4) that absorbs in the red region of the spectrum prior to coupling and couples to form a masking dye that absorbs principally in the green (e.g., similarly to the absorption of the image dye) and preferably only in the green portion of the visible spectrum. The second masking coupler has the effect of raising the minimum absorption in (4) in the red spectral region in unexposed areas toward the red spectral region absorption of the image dye formed in exposed areas. The net effect, after imagewise exposure and processing, is to create a more nearly uniform red density in (4) that is relatively small (e.g., <10%) of the maximum density of (4) in the green region of the spectrum.

The red recording layer unit (6) contains at least one dye-forming coupler which reacts with oxidized developing agent in exposed areas of the film to produce an image dye having its principal absorption in the red region of the spectrum. As much as 10 percent of total absorption by the image dye in the visible spectrum can take place in the green portion of the spectrum. Usually absorption in the blue region of the spectrum is insignificantly small. Absorption in the near infrared region of the spectrum is of no consequence, since this is not visible.

To compensate at least partially for significant unwanted absorption in the green region of the spectrum, a masking coupler is included in (6) that absorbs in the green region of the spectrum prior to coupling and that couples to form a masking dye that absorbs principally in the red (e.g., similarly to the absorption of the image dye) and preferably only in the red portion of the visible spectrum. The masking dye has the effect of raising the minimum absorption in (6) in the green spectral region in unexposed areas toward the green spectral region absorption of the image dye formed in exposed areas. The net effect, after imagewise exposure and processing, is to create a more nearly uniform green density in (6) that is relatively small (e.g., <10%) of the maximum density of (6) in the red region of the spectrum.

When a green absorbing masking coupler is incorporated in layer unit (2) or a red absorbing masking coupler is incorporated in layer unit (4), it is preferred that these masking couplers be colorless prior to processing so that they do not intercept light intended to expose the underlying green recording layer unit or red recording layer unit, respectively. Alternatively, it is common practice to omit the green absorbing masking coupler from layer unit (2) and the red absorbing masking coupler from layer unit (4), leaving only the blue absorbing masking coupler in layer unit (4) and the green absorbing masking coupler in layer unit (6).

In addition to the masking couplers (which are masking dyes that are altered in absorption by coupling) it is conventional practice to also include one or more uniform hue masking dyes (i.e., masking dyes that do not couple and retain the same hue in exposed and unexposed areas following processing) for adjustment of blue, green and red minimum densities to levels compatible with the standard color balance in color print elements. To avoid intercepting exposing radiation these uniform hue masking dyes are preferably located so that they do not intercept light used for imagewise exposure. A typical preferred location is in the antihalation layer unit (7).

A feature that distinguishes CNF-I from conventional color negative films is the color balance of the film. Specifically, the masking dye concentrations are adjusted to bring CNF-I after imagewise exposure and processing into a unique position in color space that facilitates visual judging of the color negative images to be selected for digital conversion. In quantitative terms, using CIE1976 ($L^*a^*b^*$) parameters, color space in the blue, green and red regions of the spectrum exhibits $L^*$ values of greater than 30 and $C^*$ values of less than 20.

$L^*$ values are quantifications of the perceived lightness of the image. The maximum value of $L^*$ is 100. A more readily attainable maximum value is 75. Preferred $L^*$ values are preferably at least 40. Generally the ease of judging color negative images increases as $L^*$ increases.

$C^*$ values are preferably less than 15. $C^*$ values are a composite of $a^*$ and $b^*$ values and are derived from the formula:

$$C^*[(a^*)^2+(b^*)^2]^{1/2} \quad \text{(I)}$$

$a^*$ values are a quantification along a red-green color axis. More positive $a^*$ values indicate a higher red color content while more negative $a^*$ values indicate a higher green content. $b^*$ values a quantification along a yellow-blue color axis. More positive $b^*$ values indicate a higher yellow content while more negative $b^*$ values indicate a higher blue content. The reason for employing $C^*$ values to define acceptable color balance limits is that large $a^*$ and $b^*$ values that lead to difficult to judge color negative images when simultaneously present can be individually tolerated when one of the two values is moderated to satisfy the $C^*$ criteria set forth above.

In preferred color negative films satisfying the requirements of the invention color negative images are formed following exposure and processing in which $a^*$ values are in the range of from −5.5 to +11.4 and $b^*$ values are in the range of from −7.2 to +14.3. Within these ranges all combinations of $a^*$ and $b^*$ values produce the advantages of the invention.

$L^*$, $a^*$ and $b^*$ are defined by the equations:

$$L^*=116(Y_n/Y_o)^{1/3}-16 \quad \text{(II)}$$

$$a^*=500[(X_n/X_o)^{1/3}-(Y/Y_o)^{1/3}] \quad \text{(III)}$$

$$b^*=200[(Y_n/Y_o)^{1/3}-(Z/Z_o)^{1/3}] \quad \text{(IV)}$$

where X, Y and Z are tristimulus values obtained with using the standard illuminant $D_{50}$ (5000° K.). The subscript "n" indicates the value of the sample, while the subscript "o" indicates the value at the lightest (e.g., whitest) point in the image. $Y_n$ cannot exceed $Y_o$, which in turn cannot exceed 100.

CIE1976($L^*a^*b^*$) color space quantification is one of several color space quantifications originated from the Commission International de l'Eclairage. A more detailed description of CIE1976($L^*a^*b^*$) color space be found in G. Wyszecki & W. S. Stiles, *Color Science, Concepts and Methods, Quantitative Data and Formulae,* J. Wiley & Sons, N.Y.(1982). Attention is particularly directed to pp. 143–145, 166–169 and 829. R. W. G. Hunt, *The Reproductions of Color in Photography, Printing, and Television,* Fountain Press, Tolworth, England, 1987, Chapter 8, Colour Standards and Calculations, pp. 104–130, describes the X, Y and Z tristimulus values and their calculation from color measurements; R. W. G. Hunt, *Measuring Colour,* John Wiley and Sons, p. 66; and Grum and Bartleson, *Optical Radiations Measurements, Vol.* 2, *Color Measurement,* Academic Press, 1980, p. 129. Abbott et al U.S. Pat. No. 4,865,958, here incorporated by reference, illustrates the CIE1976($L^*a^*b^*$) quantification applied to a class of photographic elements.

To achieve the unique color balance the coating coverage selections of masking coupler and preformed masking dye or, when masking coupler is absent, preformed masking dye are not those employed in color negative films intended to be printed. Apart from the unique color balance, the color negative films of this invention can take any convenient conventional form.

For example, any or all of the blue, green and red recording layer units in CNF-I can take the form of a single layer or can be divided into two separate layers differing in photographic speed. To increase photographic speed in relation to granularity the radiation sensitive silver halide grains in the layer of each layer unit coated farther from the support is chosen to exhibit a larger equivalent circular diameter (ECD). To increase contrast the layer of each layer unit coated nearer the support is chosen to exhibit the highest ECD. When the layer unit is divided into layers, the ratio of coupler (image-dye forming coupler and masking coupler) can be divided to maintain a constant silver to coupler ratio in each layer. More commonly, it is conventional practice to distribute coupler to maintain a stoichiometric deficiency of coupler in the faster layer (referred to as coupler starving). This maintains the speed advantage of coating separate layers while reducing the granularity of the overall image. The masking coupler and image dye-forming coupler coating coverages are within conventional ranges in each layer of a layer unit, although the proportions are often varied for optimum balancing. Instead of a layer unit being divided into two layers differing in speed it is also common to divide each layer unit into three layers differing in speed.

In CNF-I each of the layer units, whether formed of one or more layers, is a contiguous unit. Alternative layer order arrangements that interleave the layers of one or more layer units with those of one or two other layer units are, of course, common. A typical construction of this type is illustrated by the following:

| CNF-II |
|---|
| Protective Overcoat (1) |
| Blue Recording Layer Unit (2) |
| Interlayer (3) |
| Fast Green Recording Layer (4.1) |
| Interlayer (5.1) |
| Fast Red Recording Layer (6.1) |
| Interlayer (5.2) |
| Slow Green Recording Layer (4.2) |
| Interlayer (5.3) |
| Slow Red Recording Layer (6.2) |
| Antihalation Layer Unit (7) |
| Transparent Film Support (8) |
| Magnetic Recording Layer (9) |

Portions of CNF-I and CNF-II that are identically designated are unchanged. The green recording layer unit formed is formed by layers (4.1) and (4.2). The red recording layer unit is formed by layers (6.1) and (6.2). The interlayers (5.1), (5.2) and (5.3) can be identical to interlayer (5).

The above descriptions of layer order arrangements in color negative films are only exemplary. Any conventional layer order arrangement for color negative films can be employed. When tabular grain emulsions are employed in the green and red recording layer units, blue exposure of these layer units can be tolerated, allowing a wide variety of layer order arrangements to be considered, as illustrated by the teachings of Kofron et al U.S. Pat. No. 4,439,520, the disclosure of which is here incorporated by reference. High chloride silver halide emulsions which contain tabular grains have sufficient sensitivity to be useful in color negative film. The low native blue sensitivity of high chloride emulsions allows elimination of blue absorbers from interlayers and selection of any desired layer order arrangement. Color negative elements containing high chloride silver halide tabular grain emulsions are disclosed by House et al U.S. Pat. No. 5,320,938, the disclosure of which is here incorporated by reference.

The radiation-sensitive silver halide grains can take any conventional form useful in color negative films. Silver halide emulsions can be selected from those disclosed by *Research Disclosure,* Vol. 389, September 1996, Item 38957, I. Emulsion grains and their preparation. *Research Disclosure* is published by Kenneth Mason Publications, Ltd., Dudley House, 12 North St., Emsworth, Hampshire PO10 7DQ, England. Particularly preferred emulsions for recording green and red exposures are tabular grain emulsions having average tabular grain thicknesses (t) of less than 0.3 $\mu$m and preferably less than 0.2 $\mu$m. The use of ultrathin (<0.07 $\mu$m in thickness) tabular grain emulsions is specifically contemplated and preferred.

As employed in color negative elements the radiation-sensitive grains are chemically and spectrally sensitized. Chemical sensitization, most typically sulfur and/or gold sensitization, is described in *Research Disclosure,* Item 38957, cited above, III. Chemical sensitization. Spectral sensitization is described in IV. Spectral sensitization and desensitization, A. Spectral sensitizing dyes. The emulsion layers also contain antifoggants and/or stabilizers, such those described in VII. Antifoggants and stabilizers.

The dye-forming couplers and optional image dye modifiers in the color negative elements can be selected among conventional couplers of the type disclosed by *Research Disclosure,* Item 38957, cited above, X. Dye image formers and modifiers. Attention is particularly directed to Section B. Image-dye-forming couplers, which provides an extensive listing of suitable couplers for forming yellow, magenta and cyan dye images. Other image dye modifiers, such as development accelerators, bleach accelerators, development inhibitor releasing compounds (including couplers) are disclosed in Section C. Image dye modifiers.

The masking dyes (including both the masking couplers and the uniform hue masking dyes that remain of the same hue in exposed and unexposed areas after processing) can take any conventional form, such as those disclosed in *Research Disclosure,* Item 38957, XII. Features applicable only to color negative. The masking couplers can be initially colorless and converted to their proper masking hue during processing. Uniform hue masking dyes can be created by reacting a conventional dye forming coupler with an oxidized color developing agent, but can be selected from among a wide variety of dyes that are capable of retaining a uniform hue independent of exposure through the completion of photographic processing. Preferably uniform hue masking dyes are employed in concentrations in the range of from 0.1 to 0.3 g/m$^2$. Specifically preferred uniform hue masking dyes are those that absorb in the blue region of the spectrum. These dyes are preferably located in the antihalation layer. Specifically preferred blue absorbing uniform hue masking dyes are 2-pyrazolin-5-one nucleus containing diazo dyes, such as those illustrated in Kida et al U.S. Pat. No. 5,219,719 and Hirabayashi et al U.S. Pat. No. 5,238,797, the disclosures of which are here incorporated by reference.

Oxidized developing agent scavengers useful in the interlayers (also referred to as antistain agents) are disclosed in *Research Disclosure,* Item 38957, X. Dye image formers and modifiers, D. Hue modifiers/stabilization, paragraph (2).

Processing solution decolorizable dyes useful as antihalation dyes are disclosed in *Research Disclosure,* Item 38957, Section VIII. Absorbing and scattering materials, B. Absorbing materials and C. Discharge.

The processing solution permeable layers of the color negative elements contain hydrophilic colloids as vehicles. Vehicles and related materials are disclosed in *Research Disclosure,* Item 38957, II. Vehicles, vehicle extenders, vehicle-like addenda and vehicle related addenda.

A protective overcoat is usually present in a color negative element, but is not essential. The protective overcoat is a favored, but not exclusive, site for locating physical property modifying addenda, such as coating aids, plasticizers and lubricants, antistats and matting agents. Such addenda are described in *Research Disclosure,* Item 38957, IX. Coating physical property modifying addenda.

The transparent film supports forming the color negative elements can take any convenient conventional form. Such supports are illustrated by *Research Disclosure,* Item 38957, XV. Supports.

The magnetic recording layer unit can be conventionally constructed, as illustrated by *Research Disclosure,* Item 38957, XIV. Scan facilitating features, paragraph (2). A summary of film structure modifications incorporated in films intended to be scanned for image retrieval is provided in paragraph (1). Most conventional modifications for producing scan-only films are incompatible with the practice of the invention, since they degrade or destroy the capability of judging the image obtained by direct viewing prior to scanning.

Exposure and processing of the color negative elements of the invention can take any convenient conventional form. The color negative elements are intended for in-camera exposure using ambient or artificial (e.g., flash) illumination. In preferred forms the color negative elements are processable in the Kodak Flexicolor™ C-41 process. Other variations of color negative processing are disclosed in *Research Disclosure,* Item 38957, XVIII. Chemical development systems and XIX. Development.

Once yellow, magenta and cyan dye image records have been formed in the processed photographic elements of the invention, conventional techniques can be employed for retrieving the image information for each color record and manipulating the record for subsequent creation of a color balanced viewable image. For example, it is possible to scan the photographic element successively within the blue, green and red regions of the spectrum or to incorporate blue, green and red light within a single scanning beam that is divided and passed through blue, green and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. The electrical signal is passed through an analog to digital converter and sent to a digital computer together with locant information required for pixel (point) location within the image.

One of the challenges encountered in producing images from information extracted by scanning is that the number of pixels of information available for viewing is only a fraction of that available from a comparable classical photographic print. It is therefore even more important in scan imaging to maximize the quality of the image information available. Enhancing image sharpness and minimzing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

Illustrative systems of scan signal manipulation, including techniques for maximizing the quality of image records, are disclosed by Bayer U.S. Pat. No. 4,553,156, Urabe et al U.S. Pat. No. 4,591,923, Sasaki et al U.S. Pat. No. 4,631,578, Alkofer U.S. Pat. No. 4,654,722, Yamada et al U.S. Pat. No. 4,670,793, Klees U.S. Pat. Nos. 4,694,342 and 4,962,542, Powell U.S. Pat. No. 4,805,031, Mayne et al U.S. Pat. No. 4,829,370, Abdulwahab U.S. Pat. No. 4,839,721, Matsunawa et al U.S. Pat. Nos. 4,841,361 and 4,937,662, Mizukoshi et al U.S. Pat. No. 4,891,713, Petilli U.S. Pat. No. 4,912,569, Sullivan et al U.S. Pat. Nos. 4,920,501 and 5,070,413, Kimoto et al U.S. Pat. No. 4,929,979, Hirosawa et al U.S. Pat. No. 4,972,256, Kaplan U.S. Pat. No. 4,977,521, Sakai U.S. Pat. No. 4,979,027, Ng U.S. Pat. No. 5,003,494, Katayama et al U.S. Pat. No. 5,008,950, Kimura et al U.S. Pat. No. 5,065,255, Osamu et al U.S. Pat. No. 5,051,842, Lee et al U.S. Pat. No. 5,012,333, Bowers et al U.S. Pat. No. 5,107,346, Telle U.S. Pat. No. 5,105,266, MacDonald et al U.S. Pat. No. 5,105,469 and Kwon et al U.S. Pat. No. 5,081,692, the disclosures of which are here incorporated by reference. Techniques for color balance adjustments during scanning are disclosed by Moore et al U.S. Pat. No. 5,049,984 and Davis U.S. Pat. No. 5,541,645, the disclosures of which are incorporated by reference.

The digital color records once acquired are in most instances adjusted to produce a pleasingly color balanced image for viewing, either on a video monitor or when printed as a conventional color print. Preferred techniques for color balancing after scanning are disclosed by Giorgianni et al U.S. Pat. No. 5,267,030 the disclosures of which here incorporated by reference. The color balancing techniques of Giorgianni et al '030 described in connection with FIG. 8 represent a specifically preferred technique for obtaining a color balanced image for viewing.

Further illustrations of the capability of those skilled in the art to manage color digital image information are provided by Giorgianni and Madden *Digital Color Management,* Addison-Wesley, 1998.

EXAMPLES

The invention can be better appreciated by reference to the following specific embodiments. The suffix (C) designates control or comparative color negative films while the suffix (E) indicates example color negative films.

All coating coverages are reported in parenthesis in terms of g/m$^2$, except as otherwise indicated. Silver halide coating coverages are reported in terms of silver. The symbol "M%" indicates mole percent. ECD and t are reported as mean grain values. Halides in mixed halide grains and emulsions are named in order of ascending concentrations. Gamma ($\gamma$) for each color record is the average slope of the characteristic curve between a point on the curve lying at a density of 0.15 above minimum density (Dmin) and a point on the characteristic curve at a 0.9 log E higher exposure level, where E is exposure in lux-seconds.

GLOSSARY OF ACRONYMS

| | |
|---|---|
| HBS-1 | Tritoluoyl phosphate |
| HBS-2 | Di-n-butyl phthalate |
| HBS-3 | N-n-Butyl acetanilide |
| HBS-4 | Tris(2-ethylhexyl) phosphate |
| HBS-5 | N,N-Diethyl lauramide |
| H-1 | Bis(vinylsulfonyl)methane |
| TAI | 4-Hydroxy-6-methyl-1,3,3a,7-tetraazaindene, sodium salt |

-continued
ST-1
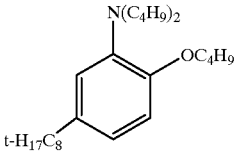
C-1
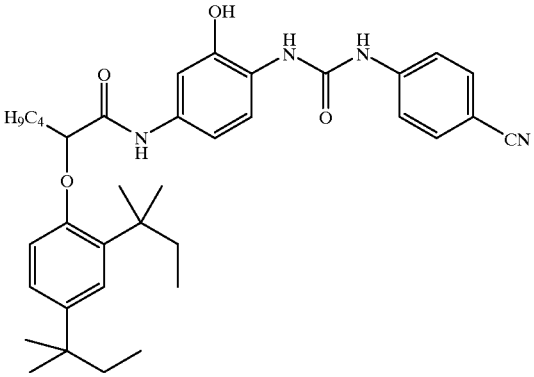
C-2
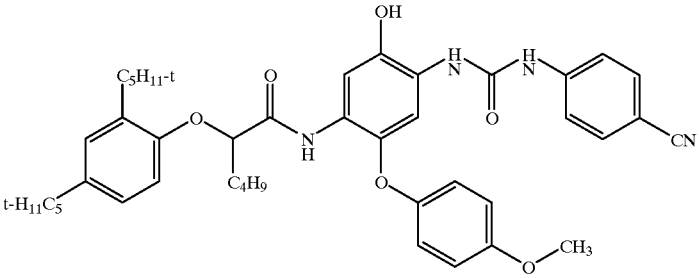
M-1
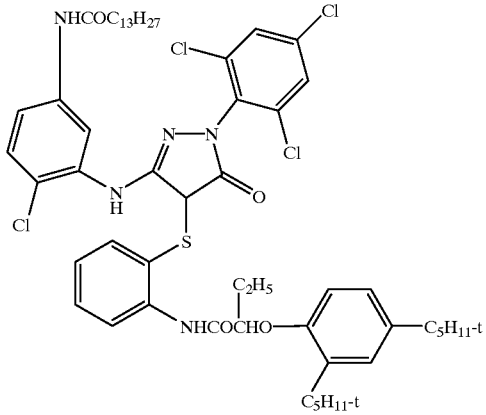
Y-1
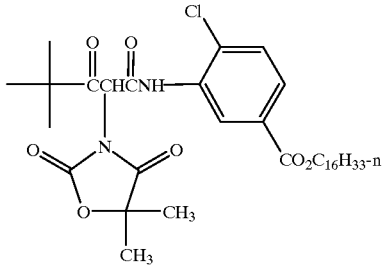

-continued
DIR-1
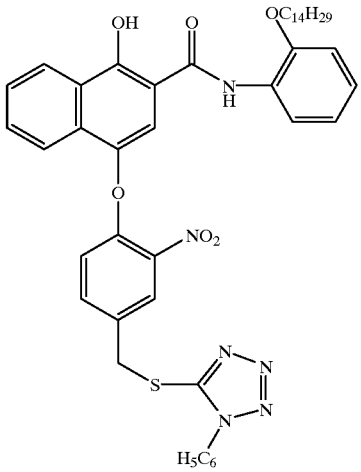
DIR-2
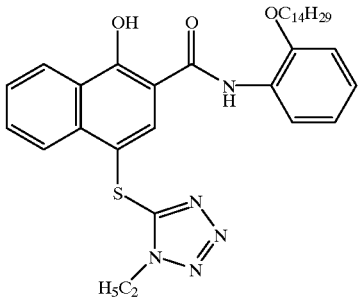
DIR-3
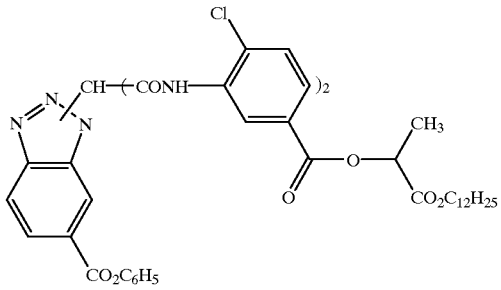
DIR-4
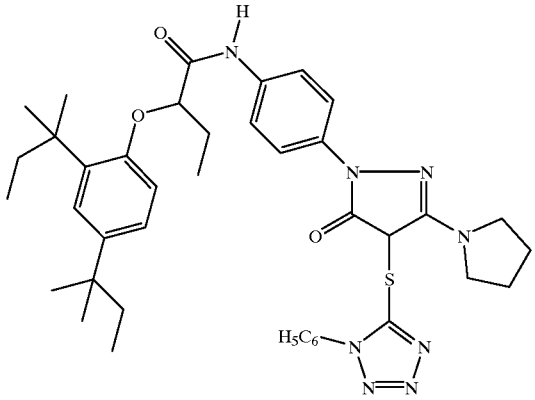

-continued
DIR-5
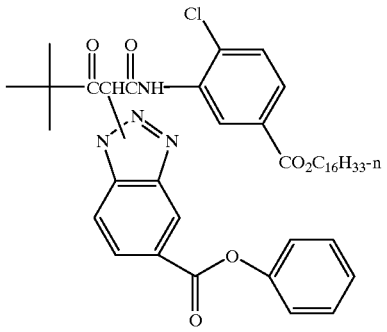
DIR-6
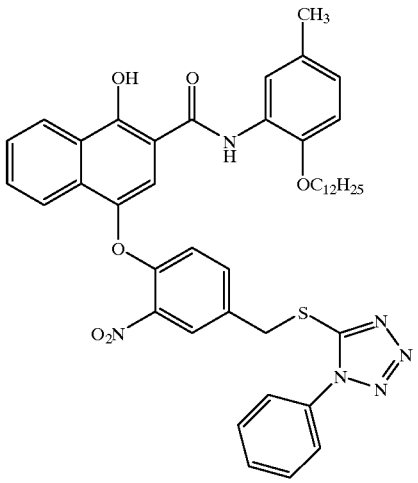
CM-1
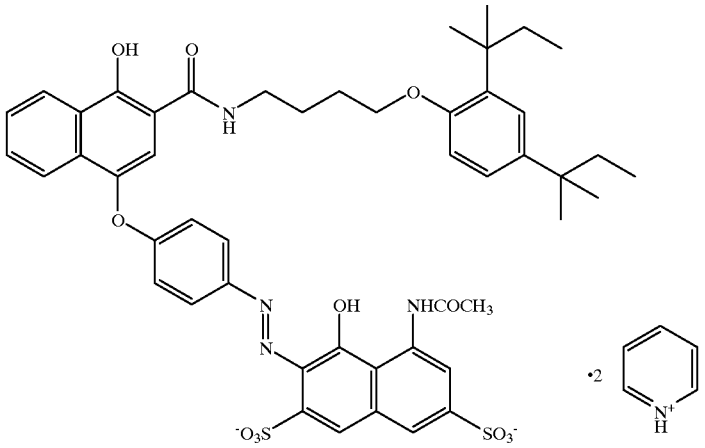

-continued
MM-1
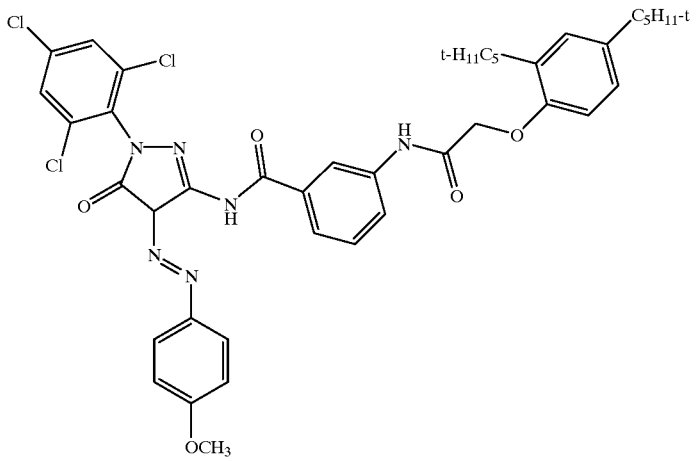
MM-2
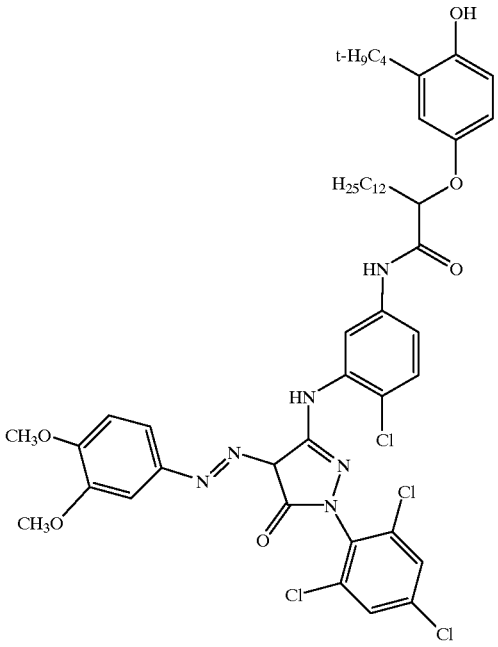
MD-1
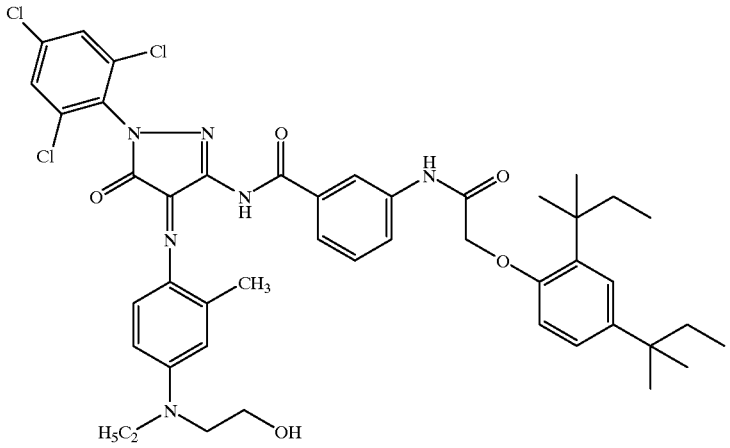

-continued
CD-1
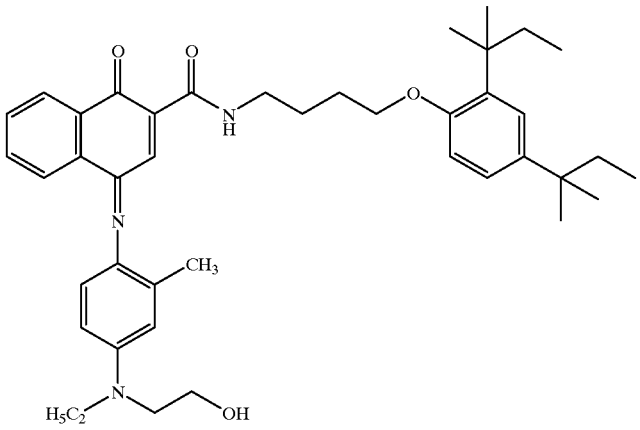
CD-2
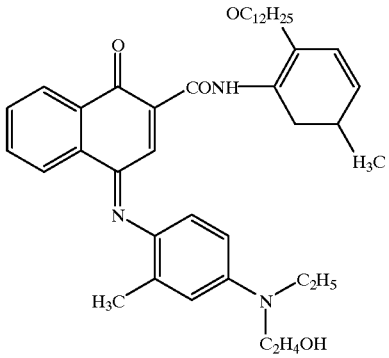
B-1
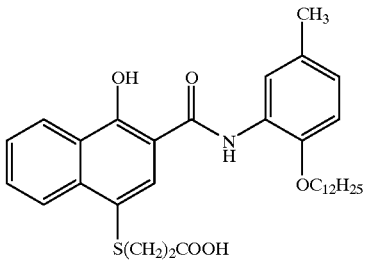
YD-1
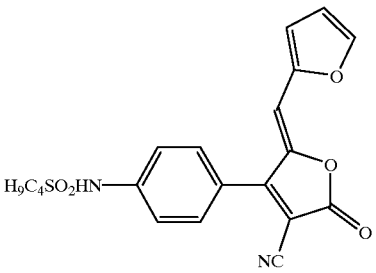
UV-1
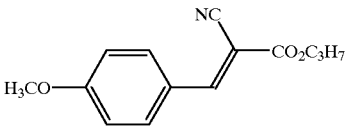
UV-2
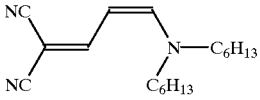

-continued

S-1

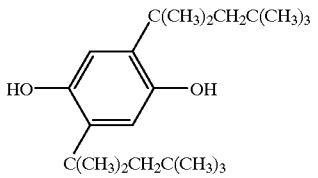

S-2

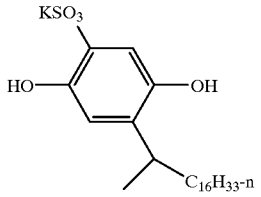

COLOR NEGATIVE FILM (CNF) ELEMENTS

CNF 001–003

CNF 001(C)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing.

Layer 1: AHU

| | |
|---|---|
| Black colloidal silver sol | (0.151) |
| UV-1 | (0.075) |
| UV-2 | (0.075) |
| Cyan masking dye CD-2 | (0.034) |
| Magenta masking dye MD-1 | (0.013) |
| Yellow masking dye MM-1 | (0.129) |
| HBS-1 | (0.240) |
| HBS-4 | (0.013) |
| Disodium salt of 3,5-disulfocatechol | (0.215) |
| Gelatin | (1.62) |

Layer 2: Interlayer

| | |
|---|---|
| Oxidized developer scavenger S-1 | (0.075) |
| HBS-4 | (0.113) |
| Gelatin | (0.538) |

Layer 3: SRU

This layer was comprised of a blend of a lower and higher (lower and higher grain ECD) sensitivity, red-sensitized tabular silver iodobromide emulsions both containing 4.1 M%, based on silver.

| | |
|---|---|
| AgIBr (0.74 μm ECD, 0.12 μm t) | (0.312) |
| AgIBr (1.25 μm ECD, 0.12 μm t) | (0.265) |
| Bleach accelerator coupler B-1 | (0.080) |
| Cyan dye forming coupler C-1 | (0.226) |
| Cyan dye forming coupler C-2 | (0.363) |
| Cyan dye forming magenta colored coupler CM-1 | (0.032) |
| HBS-2 | (0.589) |
| HBS-5 | (0.104) |
| TAI | (0.009) |
| Gelatin | (1.668) |

Layer 4: MRU

This layer was comprised of a red-sensitized tabular silver iodobromide emulsion containing 4.1 M% iodide, based on silver.

| | |
|---|---|
| AgIBr (2.25 μm ECD, 0.12 μm t) | (1.173) |
| DIR-2 | (0.011) |
| DIR-6 | (0.011) |
| Cyan dye forming magenta colored coupler CM-1 | (0.032) |
| Cyan dye forming coupler C-2 | (0.181) |
| Oxidized developer scavenger S-1 | (0.011) |
| HBS-1 | (0.044) |
| HBS-2 | (0.181) |
| HBS-3 | (0.022) |
| HBS-4 | (0.017) |
| TAI | (0.019) |
| Gelatin | (1.615) |

Layer 5: FRU

This layer was comprised of a red-sensitized tabular silver iodobromide emulsion containing 4.1 M% iodide, based on silver.

| | |
|---|---|
| AgIBr (4.0 μm ECD, 0.12 μm t) | (1.299) |
| DIR-2 | (0.022) |
| DIR-6 | (0.025) |
| Oxidized developer scavenger S-1 | (0.014) |
| Cyan dye forming coupler C-2 | (0.204) |
| HBS-1 | (0.084) |
| HBS-2 | (0.204) |
| HBS-3 | (0.050) |
| HBS-4 | (0.021) |
| TM | (0.010) |
| Gelatin | (1.453) |

Layer 6: Interlayer

| | |
|---|---|
| Oxidized developer scavenger S-1 | (0.075) |
| HBS-4 | (0.113) |
| Gelatin | (0.538) |

Layer 7: SGU

This layer was comprised of a blend of a lower and higher (lower and higher grain ECD) sensitivity, green-sensitized tabular silver iodobromide emulsions respectively containing 2.6 M% and 4.1 M% iodide, based on silver.

| | |
|---|---|
| AgIBr (0.88 μm ECD, 0.12 μm t) | (0.537) |
| AgIBr (1.2 μm ECD, 0.12 μm t) | (0.342) |
| Magenta dye forming yellow colored coupler MM-2 | (0.075) |
| Magenta dye forming coupler M-1 | (0.286) |
| Stabilizer ST-1 | (0.029) |
| HBS-1 | (0.407) |
| TM | (0.014) |
| Gelatin | (1.184) |

Layer 8: MGU

This layer was comprised of a green-sensitized tabular silver iodobromide emulsion containing 3.6 M% iodide, based on silver.

| | |
|---|---|
| AgIBr (2.85 μm ECD, 0.12 μm t) | (0.969) |
| DIR-4 | (0.011) |
| Magenta dye forming yellow colored coupler MM-2 | (0.086) |
| Magenta dye forming coupler M-1 | (0.080) |
| HBS-1 | (0.244) |
| Stabilizer ST-1 | (0.008) |
| TM | (0.016) |
| Gelatin | (1.377) |

Layer 9: FGU

This layer was comprised of a green-sensitized tabular silver iodobromide emulsion containing 3.6 M% iodide, based on silver.

| | |
|---|---|
| AgIBr (3.95 μm ECD, 0.14 μm t) | (1.292) |
| DIR-4 | (0.003) |
| Magenta dye forming coupler M-1 | (0.084) |
| HBS-1 | (0.082) |
| Stabilizer ST-1 | (0.008) |
| Gelatin | (1.405) |

Layer 10: Yellow Filter Layer

| | |
|---|---|
| Yellow filter dye YD-1 | (0.108) |
| Oxidized developer scavenger S-1 | (0.075) |
| HBS-4 | (0.113) |
| Gelatin | (0.807) |

Layer 11: SBU

This layer was comprised of a blend of a lower, medium and higher (lower, medium and higher grain thickness) sensitivity, blue-sensitized tabular silver iodobromide emulsions respectively containing 1.3 M%, 1.5 M% and 6.0 M% iodide, based on silver.

| | |
|---|---|
| AgIBr (0.50 μm ECD, 0.08 μm t) | (0.397) |
| AgIBr (1.03 μm ECD, 0.13 μm t) | (0.088) |
| AgIBr (0.96 μm ECD, 0.26 μm t) | (0.219) |
| DIR-5 | (0.027) |
| Yellow dye forming coupler Y-1 | (0.733) |
| Bleach accelerator coupler B-1 | (0.003) |
| HBS-1 | (0.381) |
| HBS-5 | (0.004) |
| TAI | (0.011) |
| Gelatin | (1.615) |

Layer 12: FBU

This layer was comprised of blend of a lower and higher (higher (conventional) and lower (tabular) grain ECD) sensitivity, blue-sensitized silver iodobromide emulsions respectively containing 4.1 M% and 14 M% iodide, based on silver

| | |
|---|---|
| AgIBr (2.9 μm ECD, 0.13 μm t) | (0.392) |
| AgIBr (1.4 μm ECD) | (0.902) |
| Yellow dye forming coupler Y-1 | (0.424) |
| DIR-5 | (0.027) |
| Bleach accelerator coupler B-1 | (0.011) |
| HBS-1 | (0.226) |
| HBS-5 | (0.014) |
| Gelatin | (1.604) |

Layer 13: Ultraviolet Filter Layer

| | |
|---|---|
| Dye UV-1 | (0.108) |
| Dye UV-2 | (0.108) |
| Unsensitized silver bromide Lippmann emulsion | (0.215) |
| HBS-1 | (0.151) |
| Gelatin | (0.699) |

Layer 13: Protective Overcoat Layer

| | |
|---|---|
| Polymethylmethacrylate matte beads | (0.005) |
| Soluble polymethylmethacrylate matte beads | (0.108) |
| Silicone lubricant | (0.039) |
| Gelatin | (0.888) |

This film was hardened at the time of coating with 2.00% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

CNF 002(E)

Except as indicated below, this sample was prepared as described above in connection with CNF 001(C).

Layer 1: AHU Changes

| | |
|---|---|
| Cyan masking dye CD-1 | (0.194) |
| Yellow masking dye MM-1 | (0.000) |
| HBS-4 | (0.880) |

Layer 3: SRU Changes

| | |
|---|---|
| Bleach accelerator coupler B-1 | (0.062) |
| Cyan dye forming coupler C-1 | (0.177) |
| Cyan dye forming coupler C-2 | (0.283) |
| Cyan dye forming magenta colored coupler CM-1 | (0.025) |
| HBS-2 | (0.460) |
| HBS-5 | (0.081) |
| Gelatin | (1.358) |

Layer 5: FRU Changes

| | |
|---|---|
| Cyan dye forming coupler C-2 | (0.108) |
| HBS-2 | (0.108) |

Layer 7: SGU Changes

| | |
|---|---|
| Magenta dye forming coupler M-1 | (0.258) |
| Stabilizer ST-1 | (0.029) |
| HBS-1 | (0.407) |

Layer 8: MGU Changes

| | |
|---|---|
| Magenta dye forming coupler M-1 | (0.050) |
| Stabilizer ST-1 | (0.005) |
| HBS-1 | (0.239) |

Layer 7: FGU Changes

| | |
|---|---|
| Magenta dye forming coupler M-1 | (0.040) |
| Stabilizer ST-1 | (0.004) |
| HBS-1 | (0.042) |

Layer 11: SBU Changes

| | |
|---|---|
| Y-1 | (0.624) |
| HBS-1 | (0.381) |

Layer 11: FBU Changes

| | |
|---|---|
| Y-1 | (0.344) |
| HBS-1 | (0.226) |

CNF 003(E)

Except as indicated below, this sample was prepared as described above in connection with Sample 002.

Layer 3: SRU Changes

| | |
|---|---|
| Bleach accelerator coupler B-1 | (0.067) |
| Cyan dye forming coupler C-1 | (0.189) |
| Cyan dye forming coupler C-2 | (0.301) |
| Cyan dye forming magenta colored coupler CM-1 | (0.027) |
| HBS-2 | (0.490) |
| HBS-5 | (0.087) |
| Gelatin | (1.503) |

Layer 4: FRU Changes

| | |
|---|---|
| Cyan dye forming coupler C-2 | (0.172) |
| HBS-2 | (0.172) |

Layer 7: SGU Changes

| | |
|---|---|
| Magenta dye forming coupler M-1 | (0.237) |
| Stabilizer ST-1 | (0.024) |
| HBS-1 | (0.363) |

Layer 11: FBU Changes

| | |
|---|---|
| Y-1 | (0.218) |
| HBS-1 | (0.123) |
| Gelatin | (1.442) |

Multiple roll samples of CNF 001–003 in 135 system format were exposed with a pictorial scene incorporating neutral gray patches, red, green, blue, cyan, magenta, and yellow color patches, and two female models using a single-lens reflex camera over an exposure range of 2-stops under-exposure through 2-stops overexposure in 1-stop increments to provide a series of test images. All of the exposed films were processed through the Kodak Flexicolor™ C-41 process, as described by *The British Journal of Photography Annual* of 1988, pp. 196–198. Another description of the use of the Flexicolor C-41 process is provided by *Using Kodak Flexicolor Chemicals,* Kodak Publication No. Z-131, Eastman Kodak Company, Rochester, N.Y.

Each the CNF 001–003 samples produced useful imaging characteristics, as illustrated by the following reported gamma values:

TABLE I

| | Status M Gamma | | |
|---|---|---|---|
| CNF | R | G | B |
| 001(C) | 0.62 | 0.64 | 0.76 |
| 002(E) | 0.52 | 0.53 | 0.65 |
| 003(B) | 0.60 | 0.55 | 0.55 |

The CIE1976($L^*a^*b^*$) parameters were obtained in the following manner: The minimum density region of each sample was measured using a Colortron™ II transmission calorimeter employing Colorshop™ 2.1 software programming. The reference white was selected to be $D_{50}$ (5000° K.) daylight proofing illuminant, which is representative of the illumination in transmission illuminators, "light boxes", or "light tables" used to view and edit processed film images in professional photography and graphics arts associated with journalism, publication, or advertising. The measured CIE1976($L^*a^*b^*$) color coordinate values for CNF 001–003 are reported in Table II.

Table II also provides the ratings of 10 photographers, who judged the ease with which color negatives produced with CNF 001–003 could be judged for selection. The rating scale was in integers from 1 to 5 inclusive, with a rating of 1 indicating a color negative image most easily judged and a rating of 5 indicating a color negative image least easily judged. The integer ratings of the 10 photographers were then averaged to produce an averaged rating (AR) shown in Table II.

TABLE II

| CNF | L* | a* | b* | C* | AR |
|---|---|---|---|---|---|
| 001(C) | 51.27 | 22.94 | 27.54 | 35.84 | 2.9 |
| 002(E) | 46.91 | 5.23 | 2.91 | 5.99 | 2.3 |
| 003(E) | 47.14 | 5.32 | 3.42 | 6.32 | 1.7 |

From Table II it is apparent that CNF 001–003 had roughly similar $L^*$ values, but differed significantly in their $a^*$, $b^*$ and $C^*$ values. The average rating was highest (least favorable) for CNF 001, that had a $C^*$ value well in excess of 20. CNF 002 and 003 exhibited roughly similar $C^*$ values, well below 20, and were given lower (more favorable) averaged ratings.

CNF 101–110

CNF 101(C)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing.

Layer 1: AHU

| | |
|---|---|
| Black colloidal silver sol | (0.107) |
| UV-1 | (0.075) |
| UV-2 | (0.075) |
| Oxidized developer scavenger S-1 | (0.161) |

-continued

| | |
|---|---|
| Cyan masking dye CD-1 | (0.034) |
| Magenta masking dye MD-1 | (0.013) |
| Yellow masking dye MM-1 | (0.095) |
| HBS-1 | (0.105) |
| HBS-2 | (0.399) |
| HBS-4 | (0.013) |
| Disodium salt of 3,5-disulfocatechol | (0.215) |
| Gelatin | (2.152) |

Layer 2: SRU

This layer was comprised of a blend of a lower and higher (lower and higher grain ECD) sensitivity, red-sensitized tabular silver iodobromide emulsions respectively containing 1.5 M% and 4.1 M% iodide, based on silver.

| | |
|---|---|
| AgIBr (0.55 μm ECD, 0.08 μm t) | (0.355) |
| AgIBr (0.66 μm ECD, 0.12 μm t) | (0.328) |
| Bleach accelerator coupler B-1 | (0.075) |
| DIR-1 | (0.018) |
| Cyan dye forming coupler C-1 | (0.359) |
| HBS-2 | (0.359) |
| HBS-3 | (0.034) |
| HBS-5 | (0.098) |
| TAI | (0.011) |
| Gelatin | (1.668) |

Layer 3: MRU

This layer was comprised of a red-sensitized tabular silver iodobromide emulsion containing 4.1 M% iodide, based on silver.

| | |
|---|---|
| AgIBr (1.30 μm ECD, 0.12 μm t) | (1.162) |
| Bleach accelerator coupler B-1 | (0.005) |
| DIR-1 | (0.018) |
| Cyan dye forming magenta colored coupler CM-1 | (0.059) |
| Cyan dye forming coupler C-1 | (0.207) |
| HBS-2 | (0.207) |
| HBS-3 | (0.037) |
| HBS-5 | (0.007) |
| TAI | (0.019) |
| Gelatin | (1.291) |

Layer 4: FRU

This layer was comprised of a red-sensitized tabular silver iodobromide emulsion containing 3.7 M% iodide, based on silver.

| | |
|---|---|
| AgIBr (2.61 μm ECD, 0.12 μm t) | (1.060) |
| Bleach accelerator coupler B-1 | (0.005) |
| DIR-2 | (0.048) |
| DIR-1 | (0.030) |
| Cyan dye forming magenta colored coupler CM-1 | (0.022) |
| Cyan dye forming coupler C-1 | (0.312) |
| HBS-1 | (0.194) |
| HBS-2 | (0.274) |
| HBS-3 | (0.060) |
| HBS-5 | (0.007) |
| TAI | (0.010) |
| Gelatin | (1.291) |

Layer 5: Interlayer

| | |
|---|---|
| Oxidized developer scavenger S-1 | (0.086) |
| HBS-4 | (0.129) |
| Gelatin | (0.538) |

Layer 6: SGU

This layer was comprised of a blend of a lower and higher (lower and higher grain ECD) sensitivity, green-sensitized tabular silver iodobromide emulsions respectively containing 2.6 M% and 4.1 M% iodide, based on silver.

| | |
|---|---|
| AgIBr (0.81 μm ECD, 0.12 μm t) | (0.251) |
| AgIBr (0.92 μm ECD, 0.12 μm t) | (0.110) |
| Magenta dye forming yellow colored coupler MM-2 | (0.054) |
| Magenta dye forming coupler M-1 | (0.339) |
| Stabilizer ST-1 | (0.034) |
| HBS-1 | (0.413) |
| TAI | (0.006) |
| Gelatin | (1.721) |

Layer 7: MGU

This layer was comprised of a blend of a lower and higher (lower and higher grain ECD) sensitivity, green-sensitized tabular silver iodobromide emulsions each containing 4.1 M% iodide, based on silver.

| | |
|---|---|
| AgIBr (0.92 μm ECD, 0.12 μm t) | (0.113) |
| AgIBr (1.22 μm ECD, 0.11 μm t) | (1.334) |
| DIR-3 | (0.032) |
| Magenta dye forming yellow colored coupler MM-2 | (0.118) |
| Magenta dye forming coupler M-1 | (0.087) |
| Oxidized developer scavenger S-2 | (0.018) |
| HBS-1 | (0.315) |
| HBS-2 | (0.032) |
| Stabilizer ST-1 | (0.009) |
| TAI | (0.023) |
| Gelatin | (1.668) |

Layer 8: FGU

This layer was comprised of a green-sensitized tabular silver iodobromide emulsion containing 4.1 M% iodide, based on silver.

| | |
|---|---|
| AgIBr (2.49 μm ECD, 0.14 μm t) | (0.909) |
| DIR-4 | (0.003) |
| DIR-3 | (0.027) |
| Magenta dye forming yellow colored coupler MM-2 | (0.054) |
| Magenta dye forming coupler M-1 | (0.113) |
| HBS-1 | (0.216) |
| HBS-2 | (0.027) |
| Stabilizer ST-1 | (0.011) |
| TAI | (0.011) |
| Gelatin | (1.405) |

Layer 9: Yellow Filter Layer

| | |
|---|---|
| Yellow filter dye YD-1 | (0.054) |
| Oxidized developer scavenger S-1 | (0.086) |
| HBS-4 | (0.129) |
| Gelatin | (0.646) |

Layer 10: SBU

This layer was comprised of a blend of a lower, medium and higher (lower, medium and higher grain ECD) sensitivity, blue-sensitized tabular silver iodobromide emulsions respectively containing 1.5 M%, 1.5 M% and 4.1 M% iodide, based on silver.

| | |
|---|---|
| AgIBr (0.55 μm ECD, 0.08 μm t) | (0.156) |
| AgIBr (0.77 μm ECD, 0.14 μm t) | (0.269) |
| AgIBr (1.25 μm ECD, 0.14 μm t) | (0.430) |
| DIR-1 | (0.030) |
| DIR-5 | (0.054) |
| Yellow dye forming coupler Y-1 | (1.022) |
| Bleach accelerator coupler B-1 | (0.011) |
| HBS-1 | (0.538) |

-continued

| | |
|---|---|
| HBS-3 | (0.060) |
| HBS-5 | (0.014) |
| TAI | (0.014) |
| Gelatin | (2.119) |

Layer 11: FBU

This layer was comprised of a blue-sensitized silver iodobromide emulsion containing 9.0 M% iodide, based on silver.

| | |
|---|---|
| AgIBr (1.04 μm ECD) | (0.699) |
| Unsensitized silver bromide Lippmann emulsion | (0.054) |
| Yellow dye forming coupler Y-1 | (0.473) |
| DIR-5 | (0.086) |
| Bleach accelerator coupler B-1 | (0.005) |
| HBS-1 | (0.280) |
| HBS-5 | (0.004) |
| TAI | (0.012) |
| Gelatin | (1.183) |

Layer 12: Ultraviolet Filter Layer

| | |
|---|---|
| Dye UV-1 | (0.108) |
| Dye UV-2 | (0.108) |
| Unsensitized silver bromide Lippmann emulsion | (0.215) |
| HBS-1 | (0.151) |
| Gelatin | (0.699) |

Layer 13: Protective Overcoat Layer

| | |
|---|---|
| Polymethylmethacrylate matte beads | (0.005) |
| Soluble polymethylmethacrylate matte beads | (0.108) |
| Silicone lubricant | (0.039) |
| Gelatin | (0.882) |

This film was hardened at the time of coating with 1.80% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

CNF 102(C)

Except as indicated below, this sample was prepared as described above in connection with CNF 101(C).

Layer 1: AHU Changes

| | |
|---|---|
| Cyan masking dye CD-1 | (0.037) |
| Magenta masking dye MD-1 | (0.061) |
| Yellow masking dye MM-1 | (0.355) |
| HBS-2 | (0.410) |
| HBS-4 | (0.061) |

Layer 3: MRU Changes

| | |
|---|---|
| Cyan dye forming magenta colored coupler CM-1 | (0.000) |

Layer 4: FRU Changes

| | |
|---|---|
| Cyan dye forming magenta colored coupler CM-1 | (0.000) |

Layer 7: MGU Changes

| | |
|---|---|
| Magenta dye forming yellow colored coupler MM-2 | (0.000) |
| HBS-1 | (0.079) |

Layer 8: FGU Changes

| | |
|---|---|
| Magenta dye forming yellow colored coupler MM-2 | (0.000) |
| Magenta dye forming coupler M-1 | (0.129) |
| Stabilizer ST-1 | (0.013) |
| HBS-1 | (0.123) |

Layer 10: SBU Changes

| | |
|---|---|
| AgIBr (0.55 μm ECD, 0.08 μm t) | (0.301) |
| AgIBr (0.77 μm ECD, 0.14 μm t) | (0.226) |
| AgIBr (1.25 μm ECD, 0.14 μm t) | (0.312) |
| Y-1 | (0.861) |
| HBS-1 | (0.457) |

Layer 11: FBU Changes

| | |
|---|---|
| Y-1 | (0.344) |
| HBS-1 | (0.215) |

CNF 103(E)

Except as indicated below, this sample was prepared as described above in connection with CNF 102(C).

Layer 1: AHU Changes

| | |
|---|---|
| Cyan masking dye CD-1 | (0.000) |
| Magenta masking dye MD-1 | (0.000) |
| Yellow masking dye MM-1 | (0.000) |
| HBS-2 | (0.261) |
| HBS-4 | (0.000) |

Layer 6: SGU Changes

| | |
|---|---|
| Magenta dye forming yellow colored coupler MM-2 | (0.000) |
| HBS-1 | (0.306) |

Layer 10: SBU Changes

| | |
|---|---|
| AgIBr (0.55 μm ECD, 0.08 μm t) | (0.156) |
| AgIBr (0.77 μm ECD, 0.14 μm t) | (0.269) |
| AgIBr (1.25 μm ECD, 0.14 μm t) | (0.430) |

Layer 11: FBU Changes

| | |
|---|---|
| Y-1 | (0.409) |
| HBS-1 | (0.248) |

CNF 104(C)

Except as indicated below, this sample was prepared as described above in connection with CNF 103(E).

Layer 1: AHU Changes

| | |
|---|---|
| Yellow masking dye MM-1 | (0.215) |

CNF 105(C)

Except as indicated below, this sample was prepared as described above in connection with CNF 103(E).

Layer 1: AHU Changes

| | |
|---|---|
| Magenta masking dye MD-1 | (0.113) |
| HBS-4 | (0.113) |

CNF 106(E)

Except as indicated below, this sample was prepared as described above in connection with CNF 103(E).

Layer 1: AHU Changes

| | |
|---|---|
| Cyan masking dye CD-1 | (0.202) |
| HBS-2 | (1.272) |

CNF 107(C)

Except as indicated below, this sample was prepared as described above in connection with CNF 106(E).

Layer 1: AHU Changes

| | |
|---|---|
| Magenta masking dye MD-1 | (0.113) |
| HBS-4 | (0.113) |

CNF 108(C)

Except as indicated below, this sample was prepared as described above in connection with CNF 107(C).

Layer 1: AHU Changes

| | |
|---|---|
| Cyan masking dye CD-1 | (0.000) |
| Yellow masking dye MM-1 | (0.215) |
| HBS-2 | (0.261) |

CNF 109(C)

Except as indicated below, this sample was prepared as described above in connection with CNF 108(C).

Layer 1: AHU Changes

| | |
|---|---|
| Cyan masking dye CD-1 | (0.202) |
| Magenta masking dye MD-1 | (0.000) |
| HBS-2 | (1.272) |
| HBS-4 | (0.000) |

CNF 110(E)

Except as indicated below, this sample was prepared as described above in connection with CNF 102(C).

Layer 1: AHU Changes

| | |
|---|---|
| Cyan masking dye CD-1 | (0.202) |
| Magenta masking dye MD-1 | (0.048) |
| Yellow masking dye MM-1 | (0.159) |
| HBS-2 | (1.272) |
| HBS-4 | (0.048) |

Layer 2: SRU Changes

| | |
|---|---|
| AgIBr (0.55 μm ECD, 0.08 μm t) | (0.391) |
| AgIBr (0.66 μm ECD, 0.12 μm t) | (0.361) |
| TAI | (0.012) |
| Gelatin | (1.727) |

Layer 3: MRU Changes

| | |
|---|---|
| C-1 | (0.258) |
| B-1 | (0.011) |
| HBS-2 | (0.258) |
| HBS-5 | (0.014) |

Layer 6: SGU Changes

| | |
|---|---|
| Magenta dye forming yellow colored coupler MM-2 | (0.000) |
| HBS-1 | (0.306) |

Layer 8: FGU Changes

| | |
|---|---|
| DIR-3 | (0.023) |
| Magenta dye forming coupler M-1 | (0.118) |
| HBS-1 | (0.113) |
| HBS-2 | (0.023) |
| Stabilizer ST-1 | (0.012) |

Layer 10: SBU Changes

| | |
|---|---|
| DIR-1 | (0.026) |
| DIR-5 | (0.046) |
| Y-1 | (0.549) |
| B-1 | (0.009) |
| HBS-1 | (0.303) |
| HBS-3 | (0.051) |
| HBS-5 | (0.012) |
| Gelatin | (1.938) |

Layer 11: FBU Changes

| | |
|---|---|
| AgIBr (1.04 μm ECD) | (0.594) |
| Unsensitized silver bromide Lippmann emulsion | (0.046) |
| Yellow dye forming coupler Y-1 | (0.165) |
| DIR-5 | (0.073) |
| Bleach accelerator coupler B-1 | (0.004) |
| HBS-1 | (0.119) |
| HBS-5 | (0.003) |
| TAI | (0.010) |
| Gelatin | (1.006) |

The CNF 101–110 series elements were imagewise exposed, processed and judged for ease of color negative image evaluation similarly as described above in connection with the CNF 001–003 series. The correlation between CIE1976($L^*a^*b^*$) parameters and photographer ratings are set out in Table III.

TABLE III

| CNF | L* | a* | b* | C* | AR |
|---|---|---|---|---|---|
| 101(C) | 54.93 | 25.20 | 33.46 | 41.89 | 3.2 |
| 102(C) | 52.70 | 22.41 | 41.32 | 47.00 | 3.2 |
| 103(E) | 69.25 | 14.42 | −7.24 | 16.14 | 2.0 |
| 104(C) | 68.17 | 10.68 | 34.00 | 35.64 | 2.9 |
| 105(C) | 55.42 | 35.30 | −23.79 | 42.57 | 4.3 |
| 106(E) | 62.35 | −4.69 | −15.56 | 16.25 | 2.4 |
| 107(C) | 44.82 | 21.46 | −36.76 | 42.57 | 4.5 |
| 108(C) | 49.12 | 32.34 | 10.07 | 33.87 | 3.9 |
| 109(C) | 59.45 | −10.68 | 23.84 | 26.12 | 4.3 |
| 110(E) | 50.57 | 0.52 | 1.32 | 1.42 | 1.2 |

From Table III it is apparent that the lowest (most favorable) ratings were obtained by the color negative film samples exhibiting $C^*$ values of less than 20.

CNF 201–205

In the previous series all of the $L^*$ were greater than 44. In this series all of the $C^*$ values were maintained less than 5 while varying the $L^*$ values, thereby demonstrating the impact of this parameter of ease of judging color negative images.

CNF 201 (E)

Except as indicated below, this sample was prepared as described above in connection with CNF 102(C).

Layer 1: AHU Changes

| | |
|---|---|
| Cyan masking dye CD-1 | (0.144) |
| Magenta masking dye MD-1 | (0.022) |
| Yellow masking dye MM-1 | (0.090) |
| HBS-2 | (0.981) |
| HBS-4 | (0.022) |

Layer 2: SRU Changes

| | |
|---|---|
| AgIBr (0.55 μm ECD, 0.08 μm t) | (0.391) |
| AgIBr (0.66 μm ECD, 0.12 μm t) | (0.361) |
| TAI | (0.012) |
| Gelatin | (1.727) |

Layer 3: MRU Changes

| | |
|---|---|
| C-1 | (0.258) |
| B-1 | (0.011) |
| HBS-2 | (0.258) |
| HBS-5 | (0.014) |

Layer 6: SGU Changes

| | |
|---|---|
| Magenta dye forming yellow colored coupler MM-2 | (0.000) |
| HBS-1 | (0.306) |

Layer 8: FGU Changes

| | |
|---|---|
| DIR-3 | (0.023) |
| Magenta dye forming coupler M-1 | (0.118) |
| HBS-1 | (0.113) |
| HBS-2 | (0.023) |
| Stabilizer ST-1 | (0.012) |

Layer 10: SBU Changes

| | |
|---|---|
| Y-1 | (0.657) |
| HBS-1 | (0.356) |

Layer 11: FBU Changes

| | |
|---|---|
| Y-1 | (0.194) |
| HBS-1 | (0.149) |

CNF 202(E)

Except as indicated below, this sample was prepared as described above in connection with CNF 201(E).

Layer 1: AHU Changes

| | |
|---|---|
| Cyan masking dye CD-1 | (0.202) |
| Magenta masking dye MD-1 | (0.054) |
| Yellow masking dye MM-1 | (0.159) |
| HBS-2 | (1.272) |
| HBS-4 | (0.054) |

CNF 203(C)

Except as indicated below, this sample was prepared as described above in connection with CNF 110(E).

Layer 1: AHU Changes

| | |
|---|---|
| Cyan masking dye CD-1 | (0.283) |
| Magenta masking dye MD-1 | (0.102) |
| Yellow masking dye MM-1 | (0.261) |
| HBS-2 | (1.675) |
| HBS-4 | (0.102) |

CNF 204(C)

Except as indicated below, this sample was prepared as described above in connection with CNF 201(E).

Layer 1: AHU Changes

| | |
|---|---|
| Cyan masking dye CD-1 | (0.399) |
| Magenta masking dye MD-1 | (0.186) |
| Yellow masking dye MM-1 | (0.392) |
| HBS-2 | (2.256) |
| HBS-4 | (0.186) |

CNF 205(C)

Except as indicated below, this sample was prepared as described above in connection with CNF 201(E).

Layer 1: AHU Changes

| | |
|---|---|
| Cyan masking dye CD-1 | (0.510) |
| Magenta masking dye MD-1 | (0.258) |
| Yellow masking dye MM-1 | (0.557) |
| HBS-2 | (2.811) |
| HBS-4 | (0.258) |

The CNF 201–205 series elements were imagewise exposed, processed and judged for ease of color negative image evaluation similarly as described above in connection with the CNF 001–003 series, except that a 2 was assigned to the least easily judged images and a 1 was assigned to the most easily judged images. The correlation between CIE1976($L^*a^*b^*$) parameters and photographer ratings are set out in Table IV.

TABLE IV

| CNF | L* | a* | b* | C* | AR |
|---|---|---|---|---|---|
| 201(E) | 58.68 | 2.19 | −0.98 | 2.40 | 1.0 |
| 202(E) | 49.86 | 1.68 | 1.06 | 1.99 | 1.1 |
| 203(E) | 39.85 | 1.46 | 2.85 | 3.18 | 1.6 |
| 204(C) | 25.53 | 3.27 | 1.49 | 3.59 | 2.0 |
| 205(C) | 16.96 | 2.71 | 4.03 | 4.86 | 2.0 |

From Table IV it is apparent that the lowest (most favorable) ratings were obtained by the color negative film samples exhibiting $L^*$ values of greater than 30.

DIGITAL IMAGE CONVERSION

The images recorded on CNF 003(E) and 110(E) were scanned with a KODAK PROFESSIONAL RFS 2035 Plus Film Scanner with the autobalance feature off using a setting appropriate for color negative films. The operation of the scanner is detailed in *KODAK PROFESSIONAL* 2035 *Plus Film Scanner User's Manual, MACINTOSH Platform,* Chapter 5. The image rendered on a CRT display following scanning was not acceptably color balanced, and the reference neutral patch RGB code values were adjusted to equality and a desirable magnitude (e.g. 130). This procedure is described in *KODAK Photojournalism Digital Toolkit, Step-by-Step Procedure.* Manual adjustment values, which can range from units of −20 to +20, were used to produce an acceptable neutral 20% reflectance patch rendering following visual assessment of the CRT display. Digital images were generated that were deemed to offer acceptable color balance for direct viewing. The manual adjustment values alternatively allowed minimum and mid-scale density and gamma adjustments to produce the standard color negative film balance used for printing.

The invention has been described in detail with particular reference to preferred embodiments thereof, but it will be understood that variations and modifications can be effected within the spirit and scope of the invention.

What is claimed is:

1. A photographic element capable of producing a multicolor negative image comprised of a transparent film support and, coated on the support, a blue recording layer unit containing radiation-sensitive silver halide grains and coupler capable of forming following imagewise exposure and processing an image dye having its primary absorption in the blue region of the spectrum, a green recording layer unit containing radiation-sensitive silver halide grains and coupler capable of forming following imagewise exposure and processing a dye image having its primary absorption in the green region of the spectrum, a red recording layer unit containing radiation-sensitive silver halide grains and coupler capable of forming following imagewise exposure and processing a dye image having its primary absorption in the red region of the spectrum, and dyes for masking portions of the dye images that in unexposed areas of the layer units in which coupling with oxidized developing agent is absent are colored following processing, wherein, to facilitate visual judging of the multicolor dye negative image resulting from imagewise exposure and processing, the dyes for masking portions of the dye images are adjusted to provide, following imagewise exposure and processing, in CIE1976($L^*a^*b^*$) color space $L^*$ values of greater than 30 and $C^*$ values of less than 20, where $C^*$ values are derived from the formula: $C^*=[(a^*)^2+(b^*)^2]^{1/2}$.

2. A photographic element according to claim 1 wherein the dyes for masking portions of the dye images include at least one masking dye that is of uniform hue in exposed and unexposed areas following processing.

3. A photographic element according to claim 2 wherein the image dye in the green recording layer unit exhibits absorption in the blue region of the spectrum and the green recording layer unit contains a masking dye-forming coupler that absorbs light in the blue region of the spectrum following processing in portions of the green recording layer unit that are not exposed to green light and that do not generate oxidized color developing agent during processing.

4. A photographic element according to claim 2 wherein the image dye in the red recording layer unit exhibits absorption in the green region of the spectrum and the red recording layer unit contains a masking dye-forming coupler that absorbs light in the green region of the spectrum following processing in portions of the red recording layer unit that are not exposed to red light and that do not generate oxidized color developing agent during processing.

5. A photographic element according to claim 1 wherein the image dye in the blue recording layer unit exhibits absorption in the green region of the spectrum and the blue recording layer unit contains an initially colorless masking dye-forming coupler that absorbs light in the green region of the spectrum following processing in portions of the blue recording layer unit that are not exposed to blue light and that do not generate oxidized color developing agent during processing.

6. A photographic element according to claim 1 wherein the image dye in the green recording layer unit exhibits absorption in the red region of the spectrum and the green recording layer unit contains an initially colorless masking dye-forming coupler that absorbs light in the red region of the spectrum following processing in portions of the green recording layer unit that are not exposed to green light and that do not generate oxidized color developing agent during processing.

7. A photographic element according to claim 1 wherein $L^*$ values are at least 40.

8. A photographic element according to claim 1 wherein $C^*$ values are less than 15.

9. A photographic element according to claim 1 wherein $a^*$ values are in the range of from −5.5 to +11.4 and $b^*$ values are in the range of from −7.2 to +14.3.

10. A photographic element according to claim 2 wherein the masking dye is located in an antihalation layer.

11. A photographic element according to claim 10 wherein the masking dye absorbs in the red region of the spectrum.

12. A photographic element according to claim 11 wherein the masking dye is coated in a coverage ranging from 0.1 to 0.3 $g/m^2$.

* * * * *